United States Patent [19]

Sargent et al.

[11] 4,180,876

[45] Jan. 1, 1980

[54] PORTABLE TOILETS

[75] Inventors: Frank T. Sargent; John M. Antos; Arthur W. Henke, all of Ann Arbor; John A. Hoffman, Brighton; Erin J. Lindsay, Ann Arbor, all of Mich.

[73] Assignee: Thetford Corporation, Ann Arbor, Mich.

[21] Appl. No.: 957,799

[22] Filed: Nov. 6, 1978

[51] Int. Cl.[2] ..... E03D 5/012; E03D 11/10; F16K 1/16

[52] U.S. Cl. ..... 4/321; 4/115; 4/323

[58] Field of Search ..... 4/115, 114, 321, 323, 4/DIG. 19

[56] References Cited

U.S. PATENT DOCUMENTS

| | | | |
|---|---|---|---|
| 3,570,018 | 3/1971 | Sargent et al. | 4/115 |
| 3,801,991 | 4/1974 | Fulton et al. | 4/321 |
| 3,851,339 | 12/1974 | Flinnar et al. | 4/321 |
| 3,949,430 | 4/1976 | Miller et al. | 4/321 |
| 4,091,475 | 5/1978 | Hewson et al. | 4/321 |
| 4,145,773 | 2/1979 | Sargent et al. | 4/321 |

*Primary Examiner*—Henry K. Artis
*Attorney, Agent, or Firm*—Olsen and Stephenson

[57] ABSTRACT

A portable toilet that has a lower holding tank with an inlet port in the top wall, and removably supported thereon an upper unit that contains a toilet bowl with an oulet port in registry with said inlet port, a flush water storage tank and flush means for discharging flush water from the storage tank into said bowl. Improved features include apparatus in the adjacent top and bottom walls of the holding tank and upper unit for releasably clamping them together, a discharge spout for the holding tank located between the adjacent walls so that the outlet of the spout is in a cavity in the bottom wall of the upper unit above the liquid level of the holding tank, and a valve-and-nozzle assembly and associated flexible conduit from the flush pump which is constructed and arranged to press fit all of the components together and mount them in proper location with respect to the toilet bowl.

18 Claims, 12 Drawing Figures

PORTABLE TOILETS

TECHNICAL FIELD

The present invention relates to self-contained portable toilets, and more particularly to improvements in known portable toilets of this type.

BACKGROUND ART

Examples of known portable toilets to which the present invention relates are disclosed in U.S. Pat. No. 3,570,018, patented Mar. 16, 1971 in the names of Sargent et al., and U.S. Pat. No. 3,949,430, patented Apr. 13, 1976 in the names of Miller et al. Reference is also made to pending United States application, Ser. No. 892,762, filed Apr. 3, 1978 in the names of Frank T. Sargent et al, now U.S. Pat. No. 4,145,773, patented Mar. 27, 1979.

Portable toilets of this character have holding tanks on which are removably mounted units which contain among other items, the toilet bowl, a flush water storage tank and flush apparatus for flushing waste material from the bowl into the holding tank. It is the conventional practice in each of these toilets to provide a valve assembly on the holding tank for opening and closing the tank inlet port that is in communication with the outlet from the toilet bowl. The tank contains a discharge spout with a closure cap, the spout normally being located in one of the side walls of the tank where it is visable and below the liquid line of the tank when the latter is full.

It is also conventional practice to provide clasp mechanisms for locking the upper units securely in place on top of the holding tanks, and these clasp mechansims are usually located on the opposite side walls of the associated holding tanks and upper units, although U.S. Pat. No. 3,949,430 discloses an improved clasp mechanism located between the top wall of the holding tank and the bottom wall of the upper unit and actuated by a handle located in a cavity in the front walls of the tank and upper unit.

The known portable toilets also have flush apparatus that includes a nozzle for directing flush water into the bowl, a manually actuated bellows pump, or the like, for pumping flush water from the storage tank to the bowl, and a conduit connected to the discharge outlet of the pump and the inlet side of the nozzle for passage of the flush water. It is the general practice to provide check-valves in the pump apparatus to enable the pump to function properly and to permit carrying the portable toilet, or merely the upper unit thereof, with water in the storage tank without inadvertent spilling or discharge of the flush water through the discharge nozzle.

DISCLOSURE OF THE INVENTION

The present invention provides a self-contained portable toilet that embodies several improved features that overcome inadequacies in the prior art toilets or that permit the toilets to be handled, manufactured or function in a more satisfactory manner.

According to one form of the present invention, a portable toilet is provided comprising a portable lower holding tank section and a portable holdig seat section removably secured thereon. The seat section has top, side and bottom walls with an outlet port in its bottom wall and defines a bowl extending between the top and bottom walls and open at the bottom to the outlet port. The holding tank section has a top wall and side and bottom walls forming a closed receptacle with an inlet port in its top wall in registry with the outlet port. A valve assembly is mounted on the holding tank section for opening and closing the inlet port. One of the features of this form of the invention is that the holding tank section and the seat section have disengageable interlocking means in their respective top and bottom walls adjacent to one of the sides of the section, the seat section being disengageable from the holding tank section when the seat section has been pivoted about an axis of the interlocking means a preselected number of angular degrees relative to the holding tank section. The holding tank section and the seat section have releasable clasp means adjacent to another of the sides of the sections opposite from the aforesaid one side for releasing or securing the sections for and against pivotal movement relative to one another. In this form of the invention the rear sides of the sections define a cavity and the clasp means includes a handle located in the cavity and moveable transversely in the cavity to move the clasp means either to its released position or to its secured position. This unique construction and arrangement provides easy access to the handle for releasing the clasp means so that the upper section can be released from the lower section, and it also provides a sheltered area for the handle of the clasp mechanism to protect it from being damaged from exterior forces, such as might be present during movement of the portable toilet.

Another feature of the present invention is the construction and arrangement of the top wall of the holding tank and the bottom wall of the upper seat section so that the holding tank section has its discharge spout located in its top wall and at a level above that of the valve assembly. This construction and arrangement enables the user of the portable toilet to remove the closure cap for the spout and to introduce selected chemical preparations or the like into the holding tank while liquid contents are in the tank without the danger of spilling the contents. It also significantly reduces the sealing problems that are involved for assuring that leakage does not occur at the closure cap while the portable toilet is in use. Still further it conceals the closure cap and spout when the portable toilet is in its assemblied position to provide a more attractive portable toilet.

In a preferred form of the present invention the disengageable interlocking means are located adjacent to the front sides of the upper and lower sections, and the releasable clasp means are located adjacent to the rear sides of the sections so that the clasp means can be released and the rear of the seat section can be raised upward by pivotal movement of the seat section around the axis of the interlocking means, and the spout is located so that it projects upward and toward the rear of the holding tank section to facilitate removal of the closure cap therefrom and introduction of the selected chemicals into the holding tank.

Still another feature of the present invention is the construction and arrangement or the clasp means so that when the handle thereof is moved to the secured position of the upper seat section relative to the holding tank section, the seat section will be pivoted downwardly toward the holding tank section and as an incident thereto a mechanical advantage will be obtained because of the long lever arm from the interlocking means to the clasp means. This is significant, because it assists in fitting the annular flange that defines the outlet port from the toilet into the seal ring located in the inlet port of the holding tank so as to assure that a tight joint is provided at these two interconnecting parts.

Still another feature of the present invention is the unique valve-and-nozzle assembly that is part of the flush means for pumping flush water from the storage tank in the upper section to the toilet bowl, the flush means including a pump in communication with the storage tank, a valve-and-nozzle assembly to discharge flush water into the bowl and a flexible conduit in communication with the pump and the valve-and-nozzle assembly. In the preferred embodiment of the invention these components can be press-fitted together so as to reduce materially the cost of assembly. Further, the valve-and-nozzle assembly is a unitary construction which provides a check-valve immediately adjacent to the nozzle so as to eliminate certain problems of inadvertent spilling from the flexible conduit during transportation of the portable toilet. Location of the check-valve immediately adjacent to the nozzle prevents the discharge of flush water that may be in the flexible conduit from a previous flush operation. Another feature of the valve-and-nozzle assembly is a collar arranged on the outer periphery of the valve body so that when the nozzle is snap-fitted into an aperture in the wall of the toilet bowl, the nozzle will be properly directed into the bowl to facilitate discharge of a single jet of flush water into the bowl to provide a vortex pattern of flow of the water therein to the bowl outlet.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figure 1:
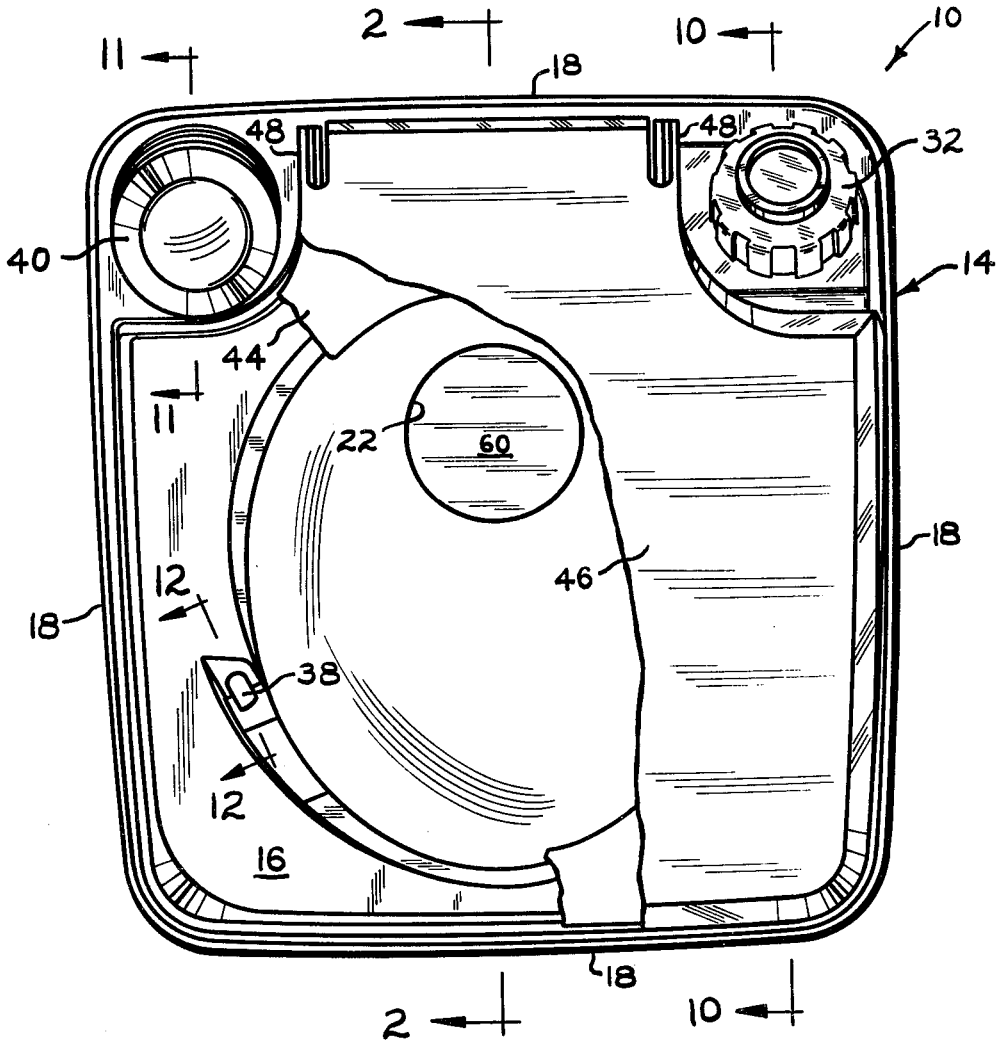
FIG. 1 is a top plan view of a portable toilet embodying one form of the present invention, portions of the cover and toilet seat being broken away to illustrate details of construction of the flush means.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology of terminology employed herein is for the purpose of description and not of limitation.

Referring now to the drawings, the invention will be described in greater detail. The portable toilet 10 comprises the lower holding tank section 12 and the upper seat section 14 removably supported thereon. The upper seat section 14 is molded of a suitable plastic material so as to have a top wall 16, side walls 18 and a bottom wall 20 with an outlet port 22 in the bottom wall defined by the annular flange 24. The upper seat section 14 also defines a bowl 26 extending between the top and bottom walls 16 and 20 and which is formed in part by the bottom wall 20. The bowl 26 is open at the bottom through the outlet port 22. A flush water compartment 28 is provided in the space between the bowl 26 and within the confines of the side walls 18 and the top and bottom walls 16 and 20. A fill spout 30 is provided in the junction between the rear side wall 18 and the top wall 16 for filling flush water into the flush water compartment 28, and a closure cap 32 is provided for closing the spout 30. A handle 34 is also molded in the rear side wall 18 for carrying the upper seat section 14.

The upper seat section 14 contains flush means 36 which includes the valve-and-nozzle assembly 38, a pump 40 and a flexible conduit 42. A more detailed description of the flush means 36 will follow hereinafter.

Also forming a part of the upper seat section 14 is the toilet seat 44 and the cover 46, both of which are pivotally mounted at 48 in a conventional manner.

The lower holding tank section 12 has a top wall 50, side walls 52 and a bottom wall 54 forming a closed receptacle with an inlet port 56 in its top wall in registry with the outlet port 22 of the upper seat section 14. A slide valve assembly 58 is mounted on the holding tank section 12 and defines the inlet port 56. The slide valve assembly includes the flat blade or valve element 60 which in the present embodiment is supported within the confines of the holding tank section movement in a horizontal plane perpendicular to the axis of the inlet port 56 for closing the inlet port and sealing the interior of the holding tank section 12 from the environment. A slide valve assembly such as is shown in prior U.S. Pat. No. 3,949,430 may be used in connection with the present invention, and for a more detailed description and explanation of the valve assembly, reference is made to this patent.

Figure 2:
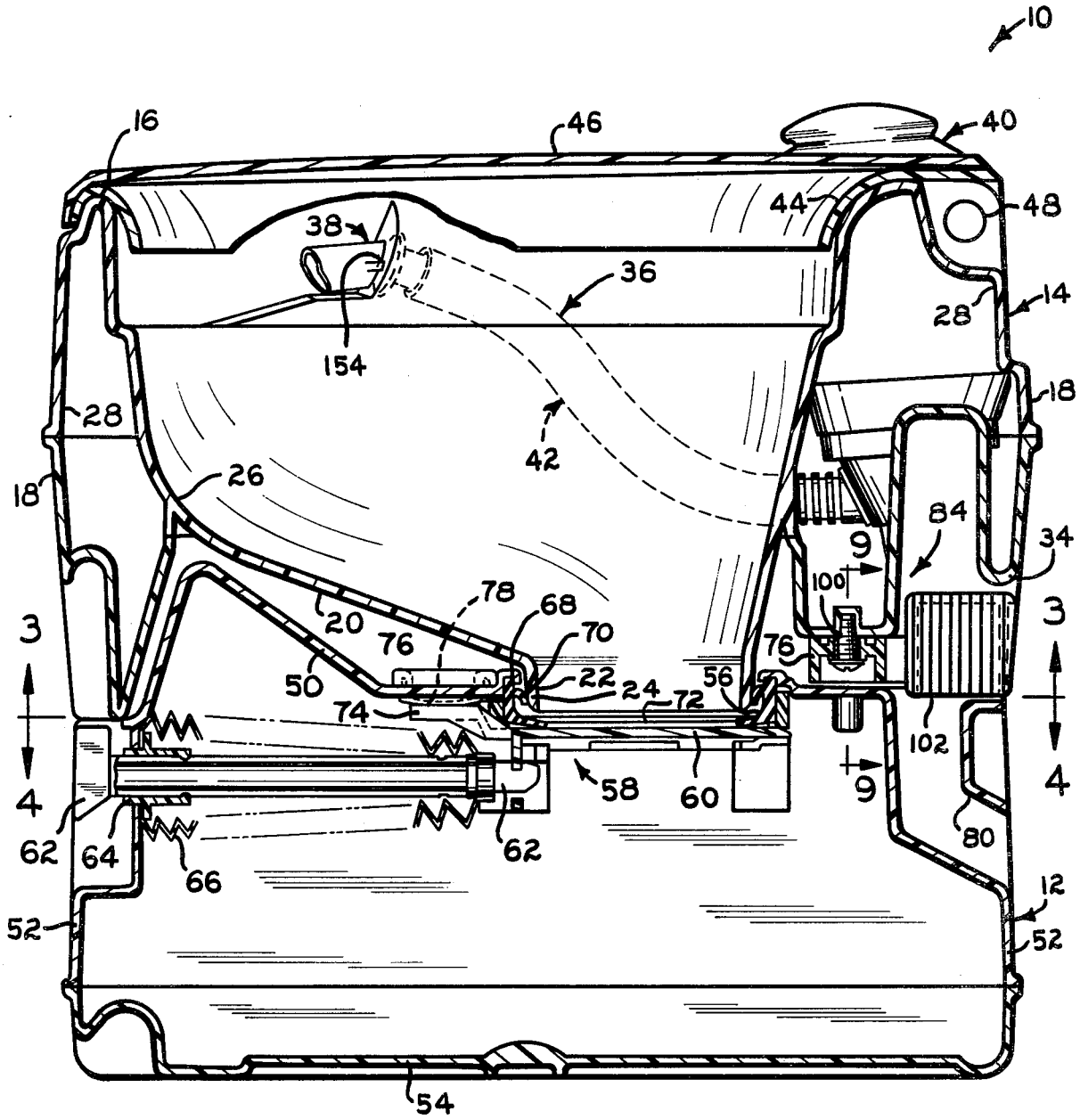
FIG. 2 is a vertical section taken on the lines 2—2 of FIG. 1.
Figure 3:
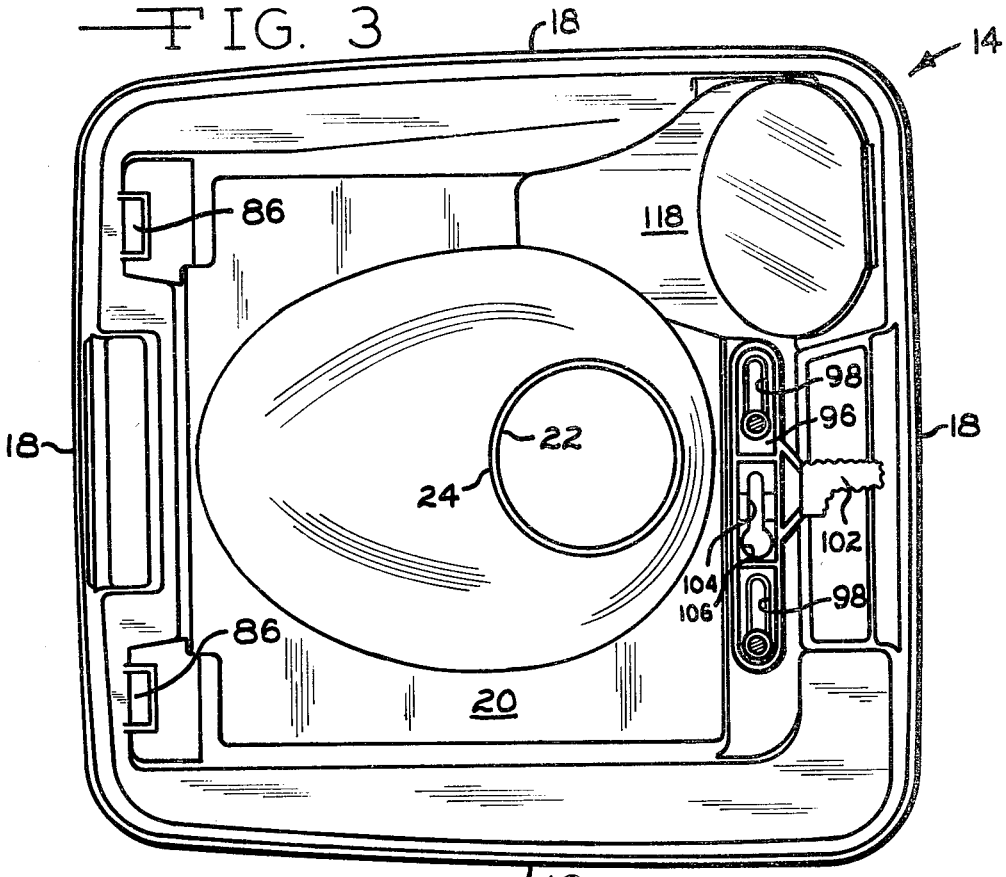
FIG. 3 is a bottom plan view of the upper seat section and a partial sectional view of the portable toilet taken on the lines 3—3 of FIG. 2.
Figure 10:
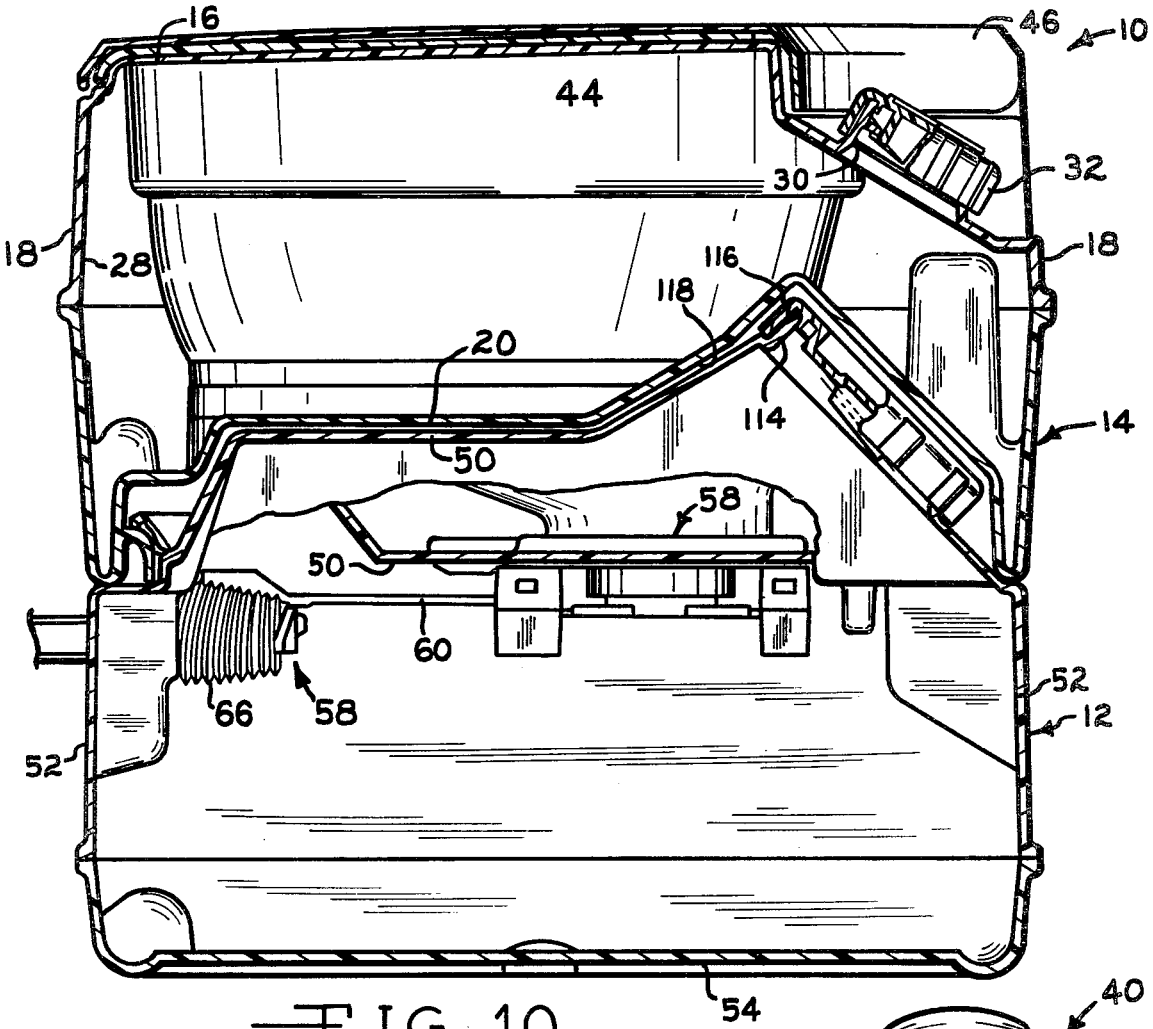
FIG. 10 is a vertical section taken on the lines 10—10 of FIG. 1, showing details of the discharge spout and closure cap of the holding tank section and the cavity therefor in the seat section.
Figure 11:
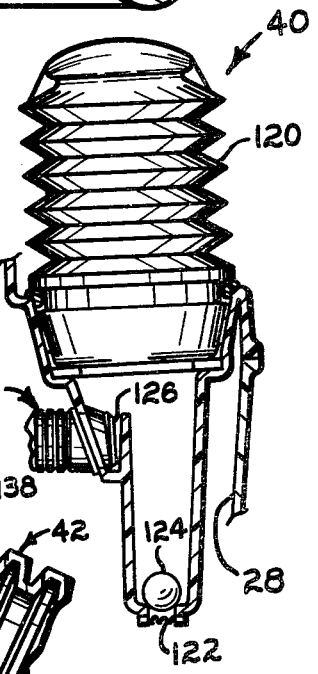
FIG. 11 is an enlarged fragmentary section taken on the lines 11—11 of FIG. 1, showing details of the pump.

Briefly, the slide valve assembly 58 includes a handle 62 to which the blade or valve element 60 is attached, and the handle extends through an opening in the front side wall 52 in a sealed relationship provided by the annular seal 64. Because the handle extends into the interior of the holding tank 12, a protective bellows 66 is fitted over the shaft of the handle 62 and is secured in sealed relationship with the annular seal 64. In the manner set forth in the aforesaid U.S. Pat. No. 3,949,430, the flat blade 60 is supported between guide surfaces for movement between the closed position shown in FIG. 2 and the open position shown in FIG. 10. The apparatus forming the inlet port in the top wall 50 includes the annular seal ring 68 which aids in defining the inlet port 56 and which includes the lip 70 into which the annular flange 24 is pressed when securing the upper seat section 14 onto the lower holding tank section 12. The annular seal ring 68 includes the lower lip 72 which is in wiping relationship with the top surface of the blade 60.

The blade 60 also includes the offset portion 74 which defines a closure element for cooperation with the vent port means 76 that is located in the top wall 50. The vent port means 76 includes a port hole (not shown) and the elastomeric seal 78 associated therewith. The offset portion 74 and the seal 78 cooperate to provide desirable venting action for the holding tank 12 during operations when the valve assembly 58 is being opened and closed. This vent apparatus is illustrated and described in greater detail in co-pending U.S. Pat. application Ser. No. 892,762, filed Apr. 3, 1978 in the names of Sargent et al., to which reference is made for a more complete description.

The lower holding tank section 12 also includes the handle 80 in the rear side wall 52 for carrying purposes.

Figure 4:
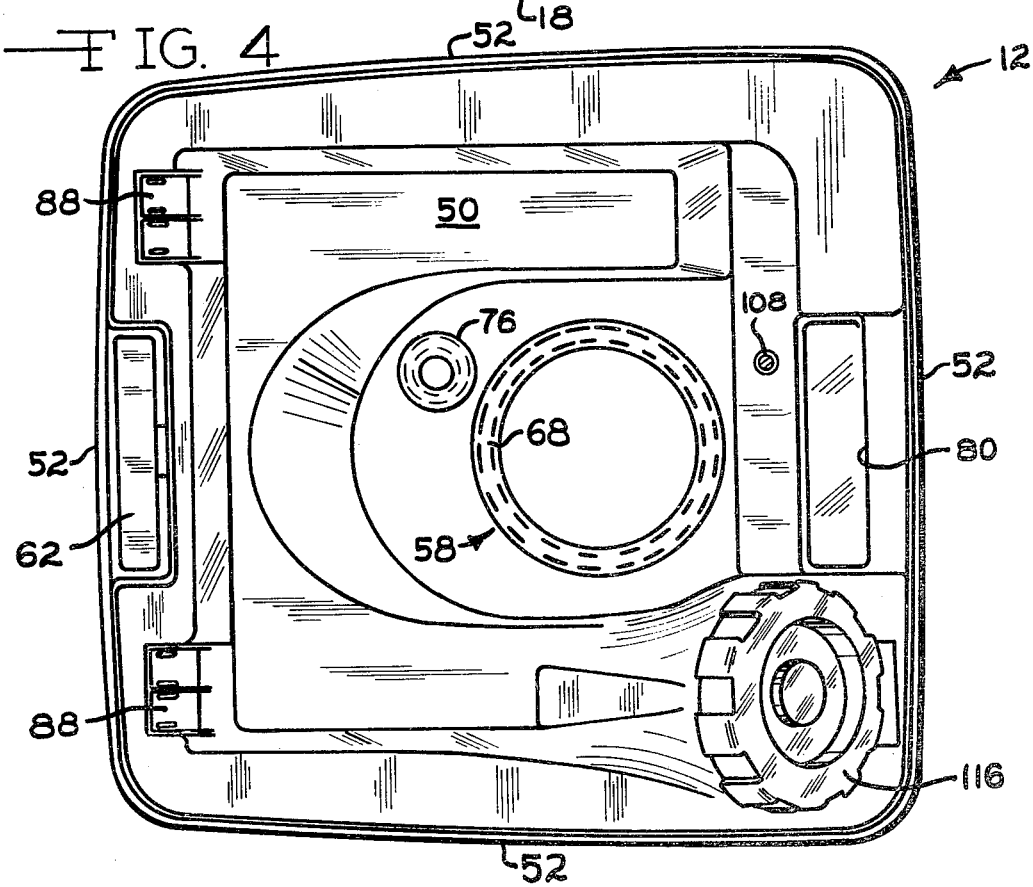
FIG. 4 is a top plan view of the holding tank section and a partial sectional view of the portable toilet assembly taken on the lines 4—4 of FIG. 2.
Figure 5:
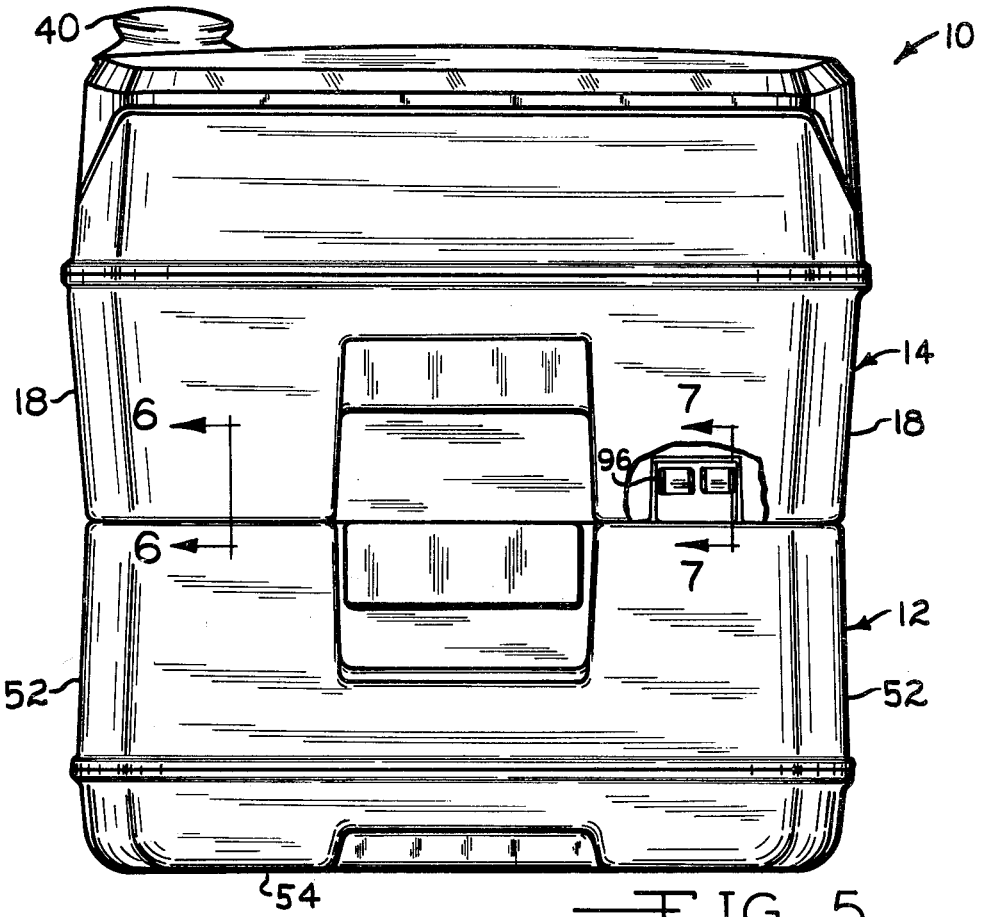
FIG. 5 is a front elevational view with a fragment broken away to illustrate details of the disengageable interlocking means.
Figure 6:
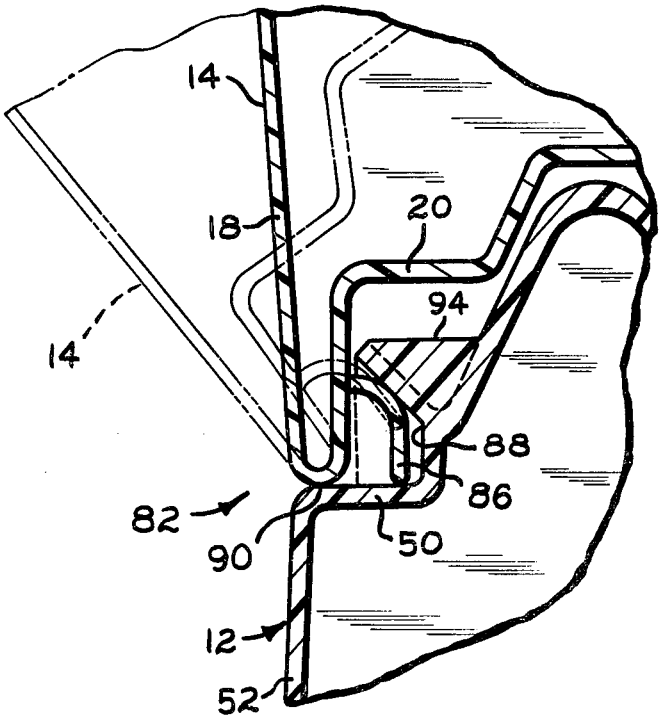
FIG. 6 is an enlarged fragmentary section taken on the lines 6—6 of FIG. 5, showing in solid lines details of the disengageable interlocking means and showing in phantom lines a position to which the upper seat section can be pivoted when disengaging the upper seat section from the lower holding tank section.
Figure 7:
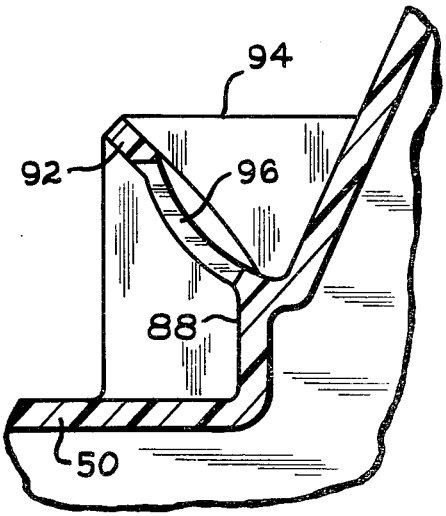
FIG. 7 is an enlarged fragmentary section taken on the lines 7—7 of FIG. 5 showing details of the disengageable interlocking means.
Figure 8:
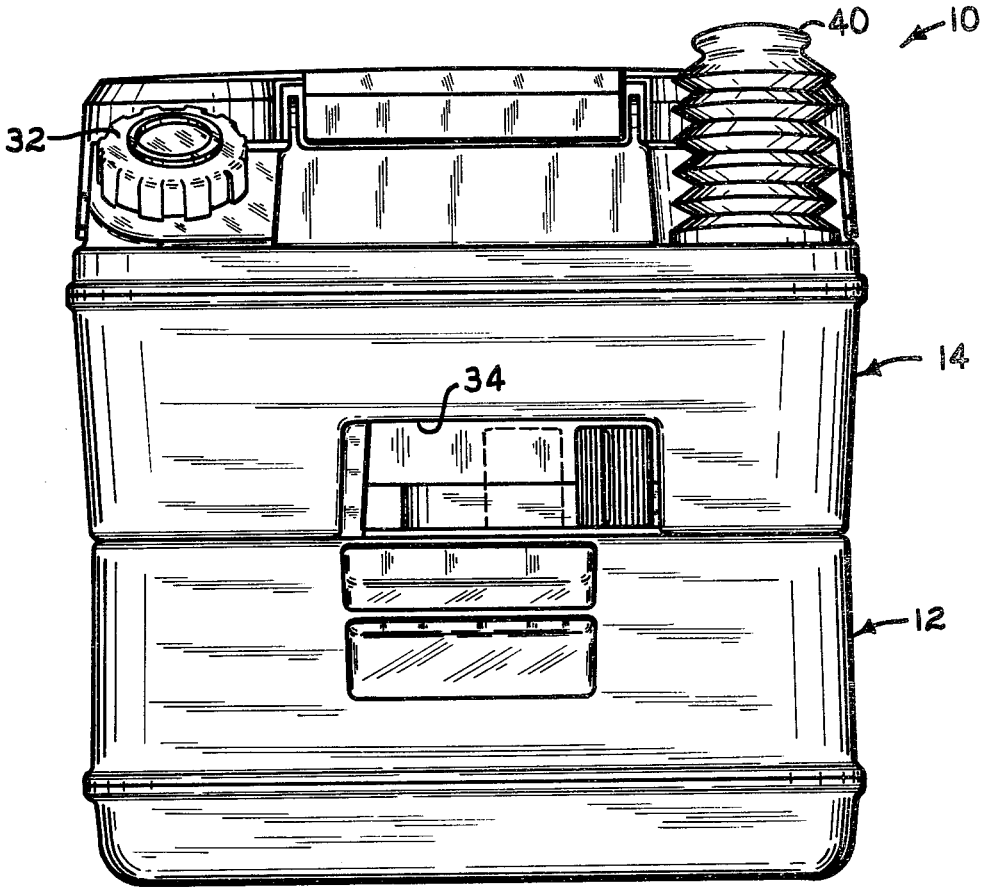
FIG. 8 is a rear elevational view showing in solid lines the position of the handle of the clasp means in its secured position and showing in broken lines its position when in a disengaged position.

One of the features of the present invention is the construction and arrangement provided for securing the upper seat section 14 onto the lower holding tank section 12. For this purpose disengageable interlocking means 82 and releasable clasp means 84 are employed. The disengageable interlocking means 82 are integrally molded into the top and bottom walls respectively of the lower holding tank section 12 and the upper seat section 14, as can be seen best in FIG. 6. As there shown, the bottom wall 20 of the upper seat section 14 has a leg 86 which extends into the socket 88 in the top wall 50 of the holding tank 12 so that the upper seat section 14 can move relative to the holding tank 12 about an axis 90 from the solid line position to the position of the seat section shown in phantom lines in FIG. 6. Thus, the leg 86 and the socket 88 form hinge-like elements located in the top and bottom walls 50 and 20 to provide a hinge axis 90 for pivotal movement of the seat section 14 relative to the holding tank section 12. The upper wall 92 of the socket is reinforced by the flange 94 and a plurality of drainage holes 96 prevent accumulation of moisture in the pockets behind the top wall 92 of the sockets 88. As best seen in FIG. 4, a plurality of spaced sockets 88 are located in the top wall of the holding tank 12 adjacent to the front side wall 52, and a plurality of legs 86 are located at similar positions adjacent to the front side wall 18 of the upper seat section 14 for fitting into these sockets.

Figure 9:
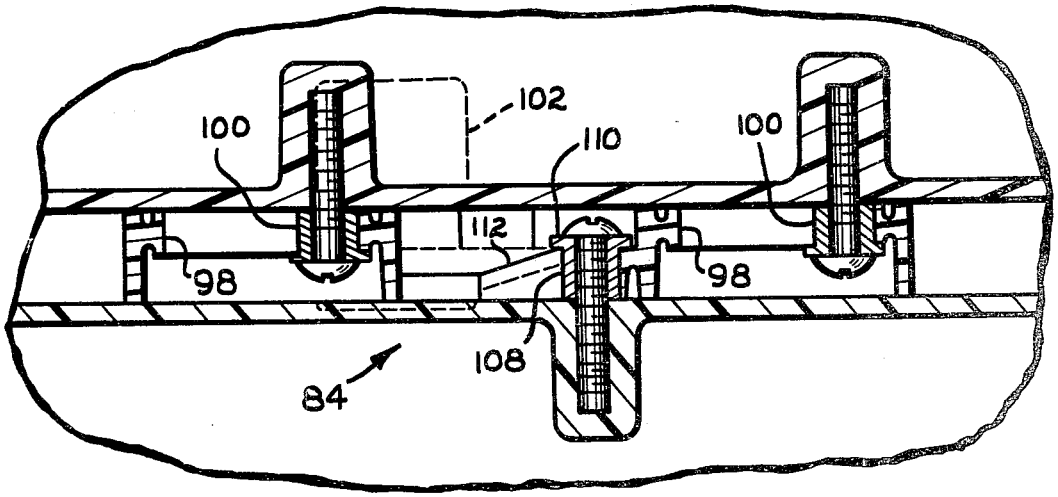
FIG. 9 is an enlarged fragmentary section taken on the lines 9—9 of FIG. 2, showing the clasp mechanism in its secured position.

The releasable clasp means 84 are located at the top and bottom walls respectively of the holding tank section 12 and the seat section 14 adjacent to the rear side walls 52 and 18 respectively. For this purpose, a strap 96 which has a pair of slots 98 therein is secured by fastening means 100 for transverse sliding movement relative to the bottom wall 20 of the upper seat section 14. This movement can be imparted to the strap 96 by means of the handle 102 that is connected thereto. The strap 96 also has a slot 104 with an enlarged opening 106. Secured to the lower holding tank section 12 is a retention member 108 that has an enlarged head 110 which can fit through the opening 106 in the slot 104, and when the strap 96 is moved transversely the enlarged head 110 will be locked in place relative to the narrower portion of the slot 104. During the movement of the strap from the position wherein the head 110 is in the opening 106 to the other end of slot 104, the enlarged head 110 will be caused to move on the ramp 112, FIG. 9, and this will cause the two sections to be pulled tightly together to the position shown in FIG. 9. During this locking action, the pivotal movement that occurs will be about the axis 90, FIG. 6, so that a relatively long lever arm from the axis 90 to the enlarged head 110 will be provided. Not only does this serve to bring the two sections 12 and 14 together, but it also aids in assuring that a good seal forms between the annular flange 24 and the sealing ring 68 where the outlet port 22 of the bowl and the inlet port 56 of the holding tank section 12 come into registry. The leverage that is provided will assure that the flange 24 is moved completely into sealed relationship with the lip 70.

Another feature of the present invention is the location of the discharge spout 114 for the holding tank 12 in the top wall 50 thereof. As seen best in FIG. 10, the discharge spout 114 is located well above the valve assembly 58 so that even when the holding tank section 12 is filled to capacity, the outlet end of the spout 114 is well above the liquid level. This serves to eliminate leakage problems that otherwise may occur at the spout if a good seal is not provided between the closure cap 116 and the spout 114. This location also is convenient for the operator of the portable toilet when it is desired to add chemical concentrates or the like into the holding tank 12. As can be seen, it is only necessary to release the clamping means 84 and then to pivot the upper seat section 14 to the position shown in phantom lines in FIG. 6, and while supporting the upper seat section in this position, the cap 116 can be removed and desired chemical compositions can be inserted into the holding tank. This feature also has desirable attributes in that the discharge spout 114 and the closure cap 116 are concealed so that the portable toilet 10 has a more attractive appearance. In the preferred form of the invention the axis of the spout 114 is inclined approximately 45° to the horizontal, and it is directed to the rear of the holding tank. To accommodate this arrangement of the spout 114 and closure cap 116, a cavity 118 is formed in the bottom wall 20 of the seat section 14.

Still another feature of the present invention is the construction and arrangement of the flush means 36. A conventional pump 40 with a bellows 120 is provided which has a suction or inlet port 122, normally closed by a ball check-valve element 124. When the hand bellows is depressed, air/water therein will be urged out of the pump via the discharge port 126 which constitutes the end of the flexible conduit 42, and the ball check-valve element 124 will then be urged into the port 122. During the return stroke of the bellows, the ball check element 124 will be raised from its seat due to pressure drop in the bellows chamber, and the water will be drawn from the water storage chamber 28 into the pump chamber. When the bellows is again depressed, the new charge of water will be discharged through the flexible conduit 42 and via the nozzle-and-valve assembly 38 into the bowl of the toilet 10. As will be understood, it is necessary to have a check-valve either at the pump 120 or somewhere in the flexible conduit 42 to allow the pump to operate satisfactorily so that it can draw water through the inlet port 122. In the present embodiment of the invention, the check-valve on the discharge side of the pump is formed within the nozzle-and-valve assembly 38.

Figure 12:
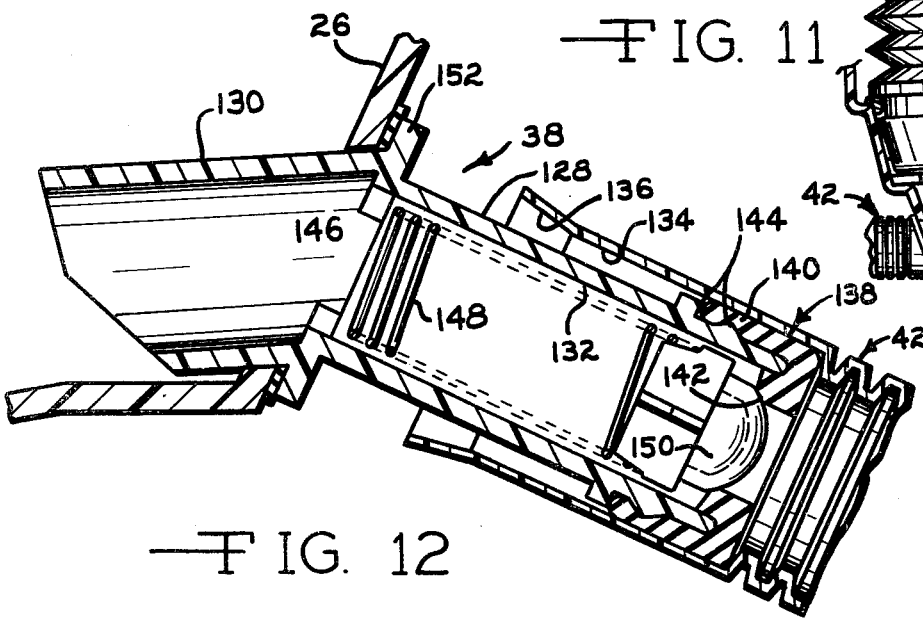
FIG. 12 is an enlarged fragmentary section taken on the lines 12—12 of FIG. 1, showing details of the valve-and-nozzle assembly of the flush means.

As shown in FIG. 12, the nozzle-and-valve assembly 38 includes the unitary valve body 128 that defines at its outlet end a nozzle 130 and at its inlet end a vavle chamber 132. The flexible conduit 42 has a socket 134 that is outwardly flared at 136, and the body member 128 has an elastomeric annulus 138 mounted on its end to provide a sleeve 140 around the outer side of the chamber and a valve seat 142 around the inner side of the chamber. The annulus 138 is fitted into the socket 134 to provide a sealed joint between the outer side of the chamber 132 and the inner side of the socket. The elastomeric annulus 38 and the body member 128 have interlocking means at 144 so that they can be press-fitted together and will be retained together as a unitary structure.

A check-valve means 146, comprising the compression spring 148 and the valve element 150, is provided. The valve element 150 is urged by the spring 148 into a closed seated position with respect to the valve seat 142. The valve element 150 is adapted to be moved off the seat 142 in response to the pressure of the liquid discharged by the pump 40. The arrangement shown serves to prevent water retained within the flexible conduit 42 from being inadvertently spilled or discharged when the portable toilet 10 is being carried. Another feature of the valve-and-nozzle assembly 38 is the collar 152 which is seated against the inner walls of the bowl 26 and is secured in place by means of the detent means 154, FIG. 2. It is to be observed that all of the components of the flush means 36 can be press-fitted together during the assembly operation and can be installed in the walls of the upper section 14. These press fit connections are present at both ends of the flexible conduit 42 as well as with respect to the other components of the flush means 36.

It is claimed:

1. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptacle with an inlet port in its top wall in registry with said outlet port, and a valve assembly mounted on said holding tank section for opening and closing said inlet port, characterized in that the holding tank section and the seat section have disengageable interlocking means in their respective top and bottom walls adjacent to one of the sides of the sections, said interlocking means including hinge-like elements located in said top and bottom walls and interconnected to provide a hinge axis for pivotal movement of the seat section relative to the holding tank section, the seat section being disengageable from the holding tank section when the seat section has been pivoted about said axis of the interlocking means a preselected number of angular degrees relative to the holding tank section, and the holding tank section and the seat section have releasable clasp means adjacent to another of the sides of the sections opposite from said one side for releasing or securing the sections respectively for or against pivotal movement relative to one another.

2. The portable toilet that is defined in claim 1, further characterized in that said disengageable interlocking means are located adjacent to the front sides of the sections, and said releasable clasp means are located adjacent to the rear sides of the sections.

3. The portable toilet that is defined in claim 2, further characterized in that the rear side walls of said sections define a cavity extending in a forward direction, and said clasp means includes a handle located in said cavity and moveable to move the clasp means either to its released position or to its secured position.

4. The portable toilet that is defined in claim 3, further characterized in that said handle is moveable transversely within said cavity for movement of said clasp means.

5. The portable toilet that is defined in claims 1 or 4, further characterized in that said releasable clasp means includes a strap secured to one of said sections for limited movement by said handle, and the other of said sections having at least one elevated retention member located in the path of movement of said strap, said retention member having an enlarged head and said strap having a slot and an associated enlarged opening of a size sufficient to receive the head of said retention member.

6. The portable toilet that is defined in claim 1, further characterized in that the walls of said holding tank section and said seat section are molded or organic plastic material, and said hinge-like elements are molded in the walls of said sections.

7. The portable toilet that is defined in claim 1, wherein said seat section has an annular flange defining said outlet port, and said holding tank section has an annular seal at its inlet port in which said annular flange is fitted in sealed relationship, and further characterized in that said interlocking means and said clasp means are located adjacent to opposite sides respectively of said sections, and said clasp means are arranged so that when securing the sections together the seat section will be pivotally urged downwardly toward the holding tank section and as an incident thereto a mechanical advantage will be obtained for urging said annular flange into said annular seal.

8. The portable toilet that is defined in claim 1, further characterized in that said holding tank section has a discharge spout in its top wall projecting in an upward direction with an outlet located above the level of said inlet port, a removeable closure cap is secured on said spout for closing said outlet, and said upper seat section has a cavity in its bottom wall to accommodate the spout and its closure cap.

9. The portable toilet that is defined in claim 8, further characterized in that said disengageable interlocking means are located adjacent to the front sides of the sections, said releasable clasp means are located adjacent to the rear sides of the sections so that the clasp means can be released and the rear of the seat section can be raised upward by pivotal movement of the seat section around the axis of said interlocking means, and said spout projects upward and toward the rear of the holding tank section to facilitate removal of the closure cap therefrom and introduction of selected chemical preparations into the holding tank.

10. A portable toilet comprising a portable lower holding tank section and a portable upper seat section removably supported thereon, said seat section having top, side and bottom walls with an outlet port in its bottom wall and defining a bowl extending between said top and bottom walls and opening at the bottom to said outlet port, said holding tank section having a top wall and side and bottom walls forming a closed receptable with an inlet port in its top wall in registry with said outlet port, and a valve assembly mounted on said holding tank section and having a valve element for opening and closing said inlet port, characterized in that the top wall of the holding tank has a spout projecting upward and terminating in an open upper end, said upper end being above the level of said valve element, and a removable closure cap is secured to the spout to close the upper end, and said portable upper seat section has a cavity in its bottom wall of a size sufficient to enclose said spout and its removable closure cap.

11. The portable toilet that is defined in claim 10, further characterized in that said spout projects upward and toward the rear side of the portable toilet at an acute angle to a horizontal plane, and all of the upper end of said spout is located above the remaining portions of the top wall of the holding tank section.

12. The portable toilet that is defined in claim 11, further characterized in that the acute angle at which the spout is inclined to the horizontal is approximately 45 degrees.

13. A portable toilet comprising a bowl, a flush water storage tank, and flush means for pumping flush water from said storage tank to said bowl, said flush means including a pump in communication with said storage tank, valve-and-nozzle assembly to discharge flush water into said bowl and a flexible conduit in communication with said pump and said valve-and-nozzle assembly for passage of the water from the pump to the assembly, characterized in that said conduit has a socket at its discharge end, and said valve-and-nozzle assembly has a body member that defines at its outer end a nozzle and at its inlet end a valve chamber, an elastomeric annulus mounted on said inlet end to provide a sleeve around the outer side of said chamber and a valve seat around the inner side of said chamber, said annulus being fitted into said socket to provide a sealed joint between the outer side of the chamber and the inner side of said socket, and a check-valve means in said chamber having a valve element normally seated on said valve seat to close the inlet end of said valve chamber and responsive to pressure of water from said pump to open for discharge of water through the nozzle to said bowl.

14. The portable toilet that is defined in claim 13, further characterized in that said body member and said elastomeric annulus have interlocking means for retaining them together as a unitary structure after the annulus is pressed onto the inlet end of the body member.

15. The portable toilet that is defined in claim 13, further characterized in that said socket is flared outward at its outer end and is formed of an elastomeric material to facilitate press-fitting said valve-and-nozzle assembly therein.

16. The portable toilet that is defined in claim 13, further characterized in that said check-valve means includes a valve element and a spring means in compression between said valve element and said chamber for urging the valve element against said seat.

17. The portable toilet that is defined in claim 13, further characterized in that said bowl has an aperture in its upper wall portion, and said nozzle extends through said aperture for discharging flush water tangentially into said bowl, said body member having a collar seated against the inner surface of said wall portion around the edge of said aperture, and a detent means on the external side of said body member and engaging the outer surface of said wall portion locking the collar in its seated position to maintain the nozzle in proper alignment relative to the bowl.

18. The portable toilet that is defined in claim 17, further characterized in that said conduit has a fitting at its inlet end for making a snap-fit connection with said pump so that the various components of said flush means can be assembled by pressing them together.

* * * * *